US009789495B1

(12) United States Patent
Dunn

(10) Patent No.: US 9,789,495 B1
(45) Date of Patent: Oct. 17, 2017

(54) DISCHARGE ELECTRODE ARRANGEMENT FOR DISC ELECTROSTATIC PRECIPITATOR (DEP) AND SCRAPERS FOR BOTH DISC AND DISCHARGE ELECTRODES

(71) Applicant: John P. Dunn, Horseheads, NY (US)

(72) Inventor: John P. Dunn, Horseheads, NY (US)

(73) Assignee: John P. Dunn, Horseheads, NY (US)

( * ) Notice: Subject to any disclaimer, the term of this patent is extended or adjusted under 35 U.S.C. 154(b) by 0 days.

(21) Appl. No.: 15/386,444

(22) Filed: Dec. 21, 2016

Related U.S. Application Data

(60) Provisional application No. 62/494,588, filed on Aug. 15, 2016.

(51) Int. Cl.

| | |
|---|---|
| ***B03C 3/74*** | (2006.01) |
| ***B03C 3/41*** | (2006.01) |
| ***B03C 3/47*** | (2006.01) |
| ***B03C 3/88*** | (2006.01) |

(52) U.S. Cl.
CPC ..... *B03C 3/743* (2013.01); *B03C 3/41* (2013.01); *B03C 3/47* (2013.01); *B03C 3/88* (2013.01); *B03C 2201/04* (2013.01); *B03C 2201/30* (2013.01)

(58) Field of Classification Search
CPC combination set(s) only.
See application file for complete search history.

(56) References Cited

U.S. PATENT DOCUMENTS 1,394,771 A * 10/1921 Kennard ..... B03C 3/10 96/40
1,444,092 A * 2/1923 Anderson ..... B03C 3/74 361/229
3,929,436 A * 12/1975 Kim ..... B03C 3/743 96/51
4,071,688 A 1/1978 Lynch et al.
4,093,432 A * 6/1978 Ahlrich ..... B03C 3/09 96/78
4,167,400 A 9/1979 Onushco
(Continued)

FOREIGN PATENT DOCUMENTS

GB 368091 A * 3/1932 ..... B03C 3/10

OTHER PUBLICATIONS

"Collection of diesel exhaust particles using electrostatic charging prior to DPF and regeneration of DPF using sliding discharge", H. Hayashi et al, Toyohashi University of Technology, IJPEST, vol. 6, No. 2, Sep. 2012.

(Continued)

*Primary Examiner* — Amber R Orlando
*Assistant Examiner* — Sonji Turner

(57) ABSTRACT

Methods and electrostatic precipitators achieve efficient separation. Scrapers are specifically designed to clean the electrodes in the electrostatic precipitators. Particulates are collected from an entrained air stream by keeping both the discharge and collection electrode surfaces clean during the precipitation process so that the electrical corona discharge remains constant and the electrical field flux lines are maintained. This is accomplished using a plurality of vertical disc electrodes and a plurality of horizontal discharge electrodes preferably combined with the ability to keep the electrodes clean during the exhaust process.

34 Claims, 14 Drawing Sheets

(56) References Cited

U.S. PATENT DOCUMENTS

| | | | | | |
|---|---|---|---|---|---|
| 4,284,420 | A | * | 8/1981 | Borysiak | B03C 3/743 96/40 |
| 5,084,077 | A | * | 1/1992 | Junker | B03C 3/10 96/39 |
| 5,110,324 | A | | 5/1992 | Testone et al. | |
| 5,348,571 | A | | 9/1994 | Weber | |
| 5,380,355 | A | * | 1/1995 | Brothers | A61L 9/22 55/360 |
| 5,429,669 | A | * | 7/1995 | Chang | B03C 3/743 95/76 |
| 5,437,713 | A | | 8/1995 | Chang | |
| 7,297,185 | B2 | | 11/2007 | Furuta et al. | |
| 8,894,745 | B2 | | 11/2014 | Dunn | |
| 9,039,815 | B2 | | 5/2015 | Dunn | |
| 9,073,062 | B2 | | 7/2015 | Dunn | |
| 9,238,230 | B2 | | 1/2016 | Dunn | |
| 2015/0246363 | A1 | * | 9/2015 | Overdahl | B03C 3/47 96/32 |

OTHER PUBLICATIONS

Electrostatic air filter (electrostatic precipitator) for pollution free industrial emission, Kelantechnics, Klean Environmental Technology (Foshan) CO., LTD., Cylindrical honeycomb kelantechnics electrostatic precipitator,https://www.alibaba.com/product-detail/Electrostatic-Air-Filter-Electrostatic-precipitator-for_358830959.html, at least as early as Jan. 13, 2017.

* cited by examiner

DISCHARGE ELECTRODE ARRANGEMENT FOR DISC ELECTROSTATIC PRECIPITATOR (DEP) AND SCRAPERS FOR BOTH DISC AND DISCHARGE ELECTRODES

REFERENCE TO RELATED APPLICATIONS

This application claims one or more inventions which were disclosed in Provisional Application No. 62/494,588, filed Aug. 15, 2016, entitled "DISCHARGE ELECTRODE ARRANGEMENT FOR DISC ELECTROSTATIC PRECIPITATOR (DEP) AND SCRAPER CONCEPTS FOR BOTH THE DISC AND DISCHARGE ELECTRODES". The benefit under 35 USC §119(e) of the United States provisional application is hereby claimed, and the aforementioned application is hereby incorporated herein by reference.

BACKGROUND OF THE INVENTION

Field of the Invention

The invention pertains to the field of electrostatic precipitators. More particularly, the invention pertains to disc electrode precipitators with horizontal discharge electrodes.

Description of Related Art

While regulations currently exist for diesel engine exhaust, at the present time the government is not enforcing emission requirements for coal stoves. Ceramic or metallic filters plus urea treatment are the dominating prior art methods used to process diesel exhaust.

There are a number of problems associated with diesel filters. The primary problem is an increase in back pressure due to porosity changes in the filter. Diesel filter failures are also related to "wet-stacking" ("wet" unburned fuel accumulating in the "stack"). Wet filters would be subject to immediate back pressure conditions.

Similarly, there is a need in the art to reduce the back pressure in electrostatic precipitators that are used by the coal and oil electric power industry.

Prior art patents show the use of circular disc electrodes with vertical discharge electrodes. Prior art patents also show vertical discharge electrodes with attracting electrodes that function independently in front of the disc electrodes.

SUMMARY OF THE INVENTION

Methods used in novel disc electrostatic precipitators achieve efficient particle collection from the entrained air stream by using scrapers that are specifically designed to scrape and clean both the discharge and collection electrode surfaces during the precipitation process so that the electrical corona discharge remains constant and the electrical field flux lines are maintained. This is accomplished using a plurality of vertical disc electrodes and a plurality of horizontal discharge electrodes preferably combined with the ability to keep the electrodes clean during the exhaust process.

In one embodiment, a method removes particles from a single main air stream in a disc electrostatic precipitator. The disc electrostatic precipitator includes a plurality of vertical rotatable circular disc collecting electrodes and a plurality of horizontal discharge electrodes located along an outer circumference of the vertical rotatable circular disc collecting electrodes. The method includes the step of passing entrained air through the plurality of horizontal discharge electrodes and the plurality of vertical rotatable circular disc collecting electrodes. A polarity of the vertical rotatable circular disc collecting electrodes is located at ground potential and high voltage direct current is applied to the discharge electrodes such that an electrical field is established between the horizontal discharge electrodes and the vertical rotatable circular disc collecting electrodes.

In another embodiment, a disc electrostatic precipitator for removing particles from a single main air stream includes a plurality of vertical rotatable circular disc collecting electrodes and a plurality of horizontal discharge electrodes located along an outer circumference of the vertical rotatable circular disc collecting electrodes. A polarity of the vertical rotatable circular disc collecting electrodes is located at ground potential and high voltage direct current is applied to the discharge electrodes such that there is an electrical field established between the horizontal discharge electrodes and the vertical rotatable circular disc collecting electrodes.

In another embodiment, a method for keeping a plurality of horizontal discharge wire electrodes in a disc electrostatic precipitator clean during a precipitating process includes the step of cleaning the horizontal discharge wire electrodes using a plurality of concentric tubular scrapers that traverse over the horizontal discharge wire electrodes to remove material deposited on the horizontal discharge wire electrodes.

In another embodiment, a method for keeping a plurality of disc electrodes in a disc electrostatic precipitator clean includes the step of cleaning the disc electrodes with a plurality of disc scrapers supported by scraper shaft spacer blocks at a first, lower end and supported at a second end on a disc support shaft spacer. A position of the disc scrapers relative to the disc electrodes is controlled by an offset in the scraper shaft spacer blocks and the disc support shaft spacer.

In another embodiment, a method for removing particles from a single main air stream in a disc electrostatic precipitator includes the steps of passing entrained air through a plurality of horizontal discharge electrodes and through a plurality of vertical circular disc collecting electrodes and cleaning the horizontal discharge electrodes and the vertical circular disc collecting electrodes with a plurality of scrapers. The plurality of scrapers are located out of the single main air stream.

DETAILED DESCRIPTION OF THE INVENTION

Figure 1:
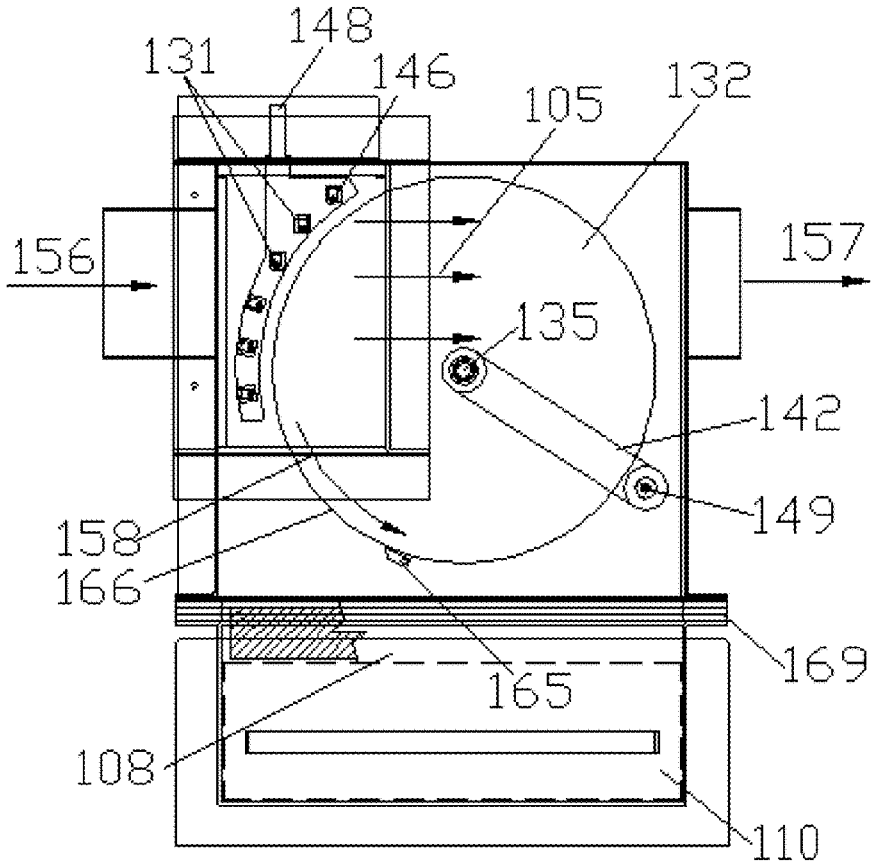
FIG. 1 shows a cross sectional side view of a disc electrostatic precipitator with horizontal discharge electrodes.

The disc electrostatic precipitators described herein have a continuous strong electrical discharge and a strong electric field. They also preferably include a mechanism to efficiently and continuously keep the electrodes clean and have very low or no particle re-entrainment. Unlike the prior art, the electrostatic precipitators described herein preferably include horizontal discharge electrodes and/or cleaning methods using scrapers. The horizontal discharge electrodes are preferably wire electrodes or rod electrodes. Although wire electrodes are predominantly described in the figures, the discharge electrodes may alternatively be rod electrodes in the embodiments described herein.

Methods and precipitator designs are described that can be used to keep the discharge electrodes and the rotatable disc electrodes clean. A method for achieving the desired and efficient operating performance of an electrostatic precipitator keeps both the discharge and collection electrodes surfaces clean during the precipitation process so that the electrical corona discharge remains constant and that electrical field flux lines can be maintained.

The method combines the use of a plurality of rotatable vertical disc electrodes with fixed scrapers on each side and a plurality of horizontal discharge electrodes with tube scrapers that slide over the discharge wire electrodes to remove deposited material. The scrapers are preferably used during the precipitating process.

The different scrapers described herein may be made of materials including, but not limited to, conductive or non-conductive material. In some preferred embodiments, the scrapers are made from nonconductive dielectric refractory tubular material. This method also includes a major reduction in particle re-entrainment by removing the collected material from the disc electrode out of the main air flow stream, while the material collected on the discharge electrodes agglomerates into larger particles that fall by gravity, or are collected on the disc electrode and removed during the disc cleaning process.

The discharge electrode arrangement used in prior art electrostatic precipitators is vertical and located either in front or between the collecting plates. In the electrostatic precipitators described herein, the discharge electrodes are preferably located horizontally across and in front of the collecting disc electrodes with each horizontal discharge wire electrode positioned to follow the circular periphery of the collecting discs electrode at a common specified distance from the disc electrodes. A polarity of the collecting disc electrodes is located at ground potential and high voltage direct current is applied to the discharge electrodes such that an electrical field is established between the horizontal discharge electrodes and the vertical rotatable circular disc collecting electrodes.

The process uses a plurality of circular discs and a plurality of horizontal discharge electrodes with scrapers that keep the electrodes clean during the precipitating process. This combination results in achieving an efficient, continuously, cost effective and improved method of collecting particulates from entrained gases.

The scrapers preferably are located and operate outside of the main air stream. The circular disc electrodes preferably have two scrapers: one for the sides and another for the leading edge of the disc electrodes. The horizontal discharge electrodes follow the circumference of the circular disc electrodes. The discharge wire or rod electrodes are kept clean by scraper tubes that slide over the surface of the discharge electrodes. The electrostatic precipitators are able to maintain a strong charge and electric field. They also have extremely low particle re-entrainment.

In some embodiments, the discharge wire or rod electrodes are preferably kept clean by heating the discharge electrodes before scraping.

Depending on the application, some auxiliary equipment that might be needed includes a HVDC power supply, one or more electric motors (for disc rotation, the discharge wire scraper, and/or the blower), a disposal collection container, one or more sensors, and/or AC for heating the discharge electrodes.

The DEPs described herein address a number of the problems associated with diesel filters, including the increase in back pressure due to porosity changes in the filter. The DEPs also address the need to reduce the back pressure in electrostatic precipitators that are used by the coal and oil electric power industry. While the consequences of wet filters have not yet been tested, it is anticipated that, unlike in the prior art, wet filters will cause only a minor interruption in the precipitation process.

Some advantages of the DEPs described herein include low back pressure, low particle re-entrainment, low pressure drop, the ability to clean discharge and disc electrodes during operation, the scrapers being located out of the main air stream, the main air stream being located in the upper half of the disc electrodes, the ability to work during a cold start, and at all operating temperatures, particulate collection of greater than 95%, and being able to scale up to meet high CFM (cubic feet per minute) requirements.

The disc electrostatic precipitators (DEPs) described herein could be used in many different applications that require electrostatic precipitators for particle collection and removal. One example is the capture of particulates from coal stove exhaust. Another example is for removal of particles from diesel exhaust, mainly for off-road applications. Additional examples include cleaning exhaust from plasma gasification scrubbers, and the scrubbers used in the syngas (synthesis gas) process of burning garbage.

FIGS. 1-11 illustrate electrostatic precipitators with discharge electrodes 131 that are located horizontally across and in front of collecting disc electrodes 132, with each horizontal discharge wire electrode 131 positioned to follow the circular periphery of the collecting discs electrode 132 at a common specified distance from the collecting disc electrode 132.

Both the diameter and number of discharge electrodes 131, as well as the spacing blocks 136 (shown in FIG. 2) can be varied based on the electrical and application requirements. For the electrical limits, the distance between the horizontal discharge wire electrodes 131 must be greater than the distance between the discharge wire electrodes and the leading edge 166 (shown in FIG. 7) of the disc electrode 132, illustrated in FIG. 8.

FIG. 1 is a cross sectional side view of a DEP where the exhaust entrained gas enters at 156 and exits at 157. The main gas flow is predominately in the upper portion of the disc electrode 132 because of the position of the input 156 and exit 157 ducts and the negative operating pressure that is controlled by an external blower (not shown) located at the exit 157.

Cleaning the disc electrode 132 at specific time intervals is achieved by using stationary disc scrapers 142 that are located below the disc drive shaft 135 but not fastened to either the disc rotatable shaft 135 or the scraper stationary shaft 149. FIG. 1 also shows the relative position of a disc edge scraper 165 that is used to remove material deposited on the leading edge 166 of the disc electrode 132.

FIG. 1 also shows the direction of rotation 158 of the disc electrode 132. This allows for the collected material to rotate into the edge disc scraper 165 and the disc scraper 142 where the discharged material falls by gravity into the collection tray 110 located in the collection chamber 108. Removal of the material from both the disc electrode 132 and the edge disc scraper 165 occurs out of the main airstream 105, which prevents particle re-entrainment.

Figures 2A, 2B:
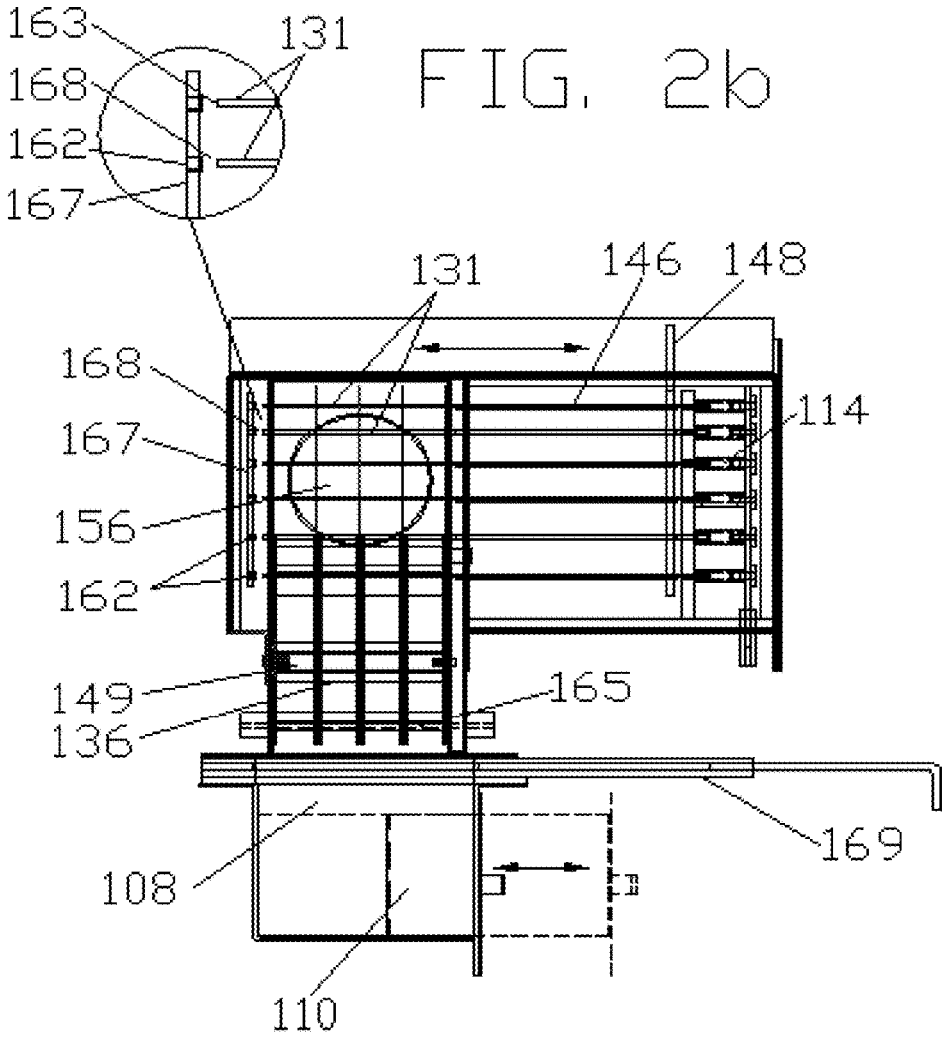
FIG. 2*a* shows a cross sectional front view of horizontal discharge wire electrodes used in a disc electrostatic precipitator with the discharge electrodes and tubular scrapers in an operating position.
FIG. 2*b* shows an exploded view of a portion of FIG. 2*a*.

FIGS. 2*a* and 2*b* show a front, cross sectional view of an embodiment of a disc electrostatic precipitator with horizontal discharge electrodes 131. This horizontal arrangement of the discharge electrodes 131 is effective not only in charging the particles, but also in allowing the placement of concentric tubular or sleeve scrapers 146 over and in close proximity to the discharge wire electrode 131. The scrapers 146 slide over the discharge wire electrodes 131 by moving the scraper tube bar 148 forward to scrape and remove material that has collected on the discharge wire electrode 131 during operation.

One end of the discharge wire electrodes 131 is fastened to electrical terminal connectors 114 and the other end 163 is left open-ended. A larger tubular scraper 162 that allows the smaller diameter tube scraper 146 to move in for cleaning is located on the bar 167. The tubular scraper 146 is used to clean the discharge wire electrodes 131.

Factors to consider when choosing a material for the tubular scrapers 162 include wear resistance, as well as electrical and dimensional relation to the discharger wire electrode. Both stainless steel tubing and alumina tubing can be used depending on how they are engineered into the structure.

Since the discharge wire electrodes 131 are connected to the electrical terminal connectors 114 at a first end and not connected at a second end 163, this leaves an open space 168 between the end 163 of the stationary discharge wire electrodes 131 and the larger tube scraper support bar 167. FIG. 2*b* is an expanded view of the area that is not connected. This embodiment allows scraped material to be discharged at the end of the discharge wire electrode 131 to fall by gravity into the collection tray 110. In order to remove material collected on the discharge scraper tubes 146, the scraper tube support bar 148 continues its forward motion and moves the discharge scraper tubes 146 into another close fitting large inside diameter tube 162 to be cleaned, detailed in FIG. 3*b*. For this application, the discharge wire electrode 131 must be strong enough to resist being attracted towards the disc electrodes 132. Several ways to increase the strength of the discharge wire electrodes 131 are to use larger diameter wire electrodes 131 or including a harder wire in the discharge wire electrodes 131. The wire may be made of a metal including, but not limited to, tungsten, hardened stainless steel or nichrome.

Figure 3B:
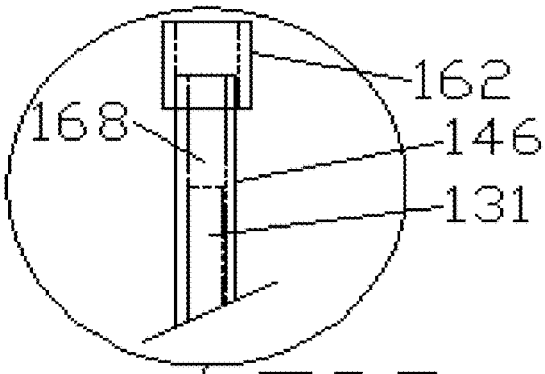
FIG. 3*b* shows an exploded view of a portion of FIG. 3*a*.
Figure 3A:
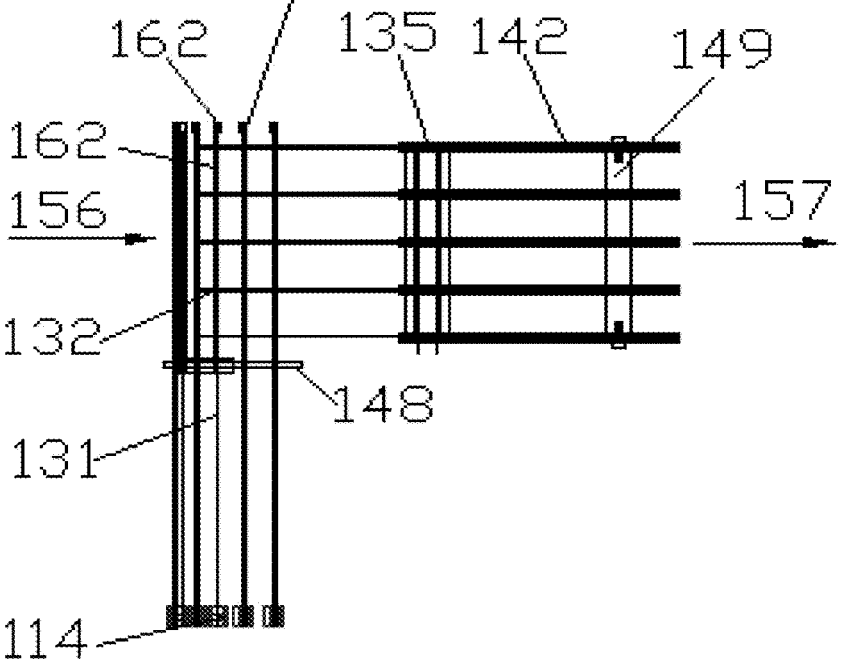
FIG. 3*a* shows a cross sectional top view of a horizontal discharge wire electrode with one end open and the other end fastened and a concentric, moveable tubular scraper in the completed scraping position.

FIG. 2*a* also shows how the collection tray 110 can be removed from the collection chamber 108 and replaced during operation using a vacuum slide gate 169. The vacuum slide gate 169 is closed and then the collection tray 110 is removed from the side of the collection chamber 108. There are a number of other possible collection tray designs and methods that could be used. The one shown is preferable for a coal stove application. FIGS. 3*a* and 3*b* show a top view of the discharge electrode scraping tubes 162 in a completed scraping position.

Figure 4:
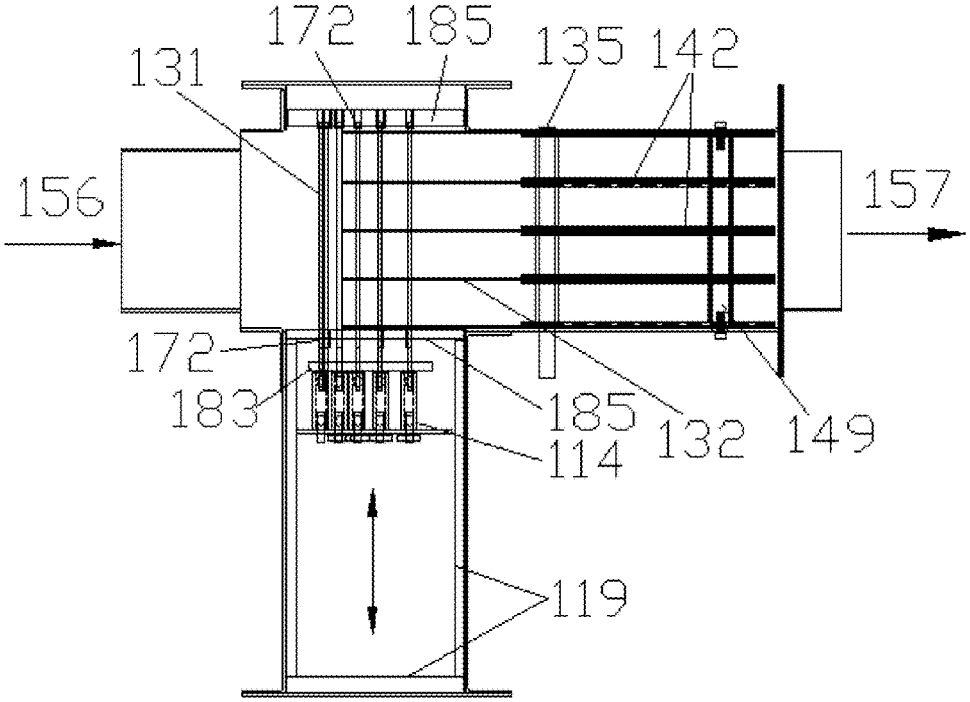
FIG. 4 shows a cross sectional top view of moveable horizontal discharge wire electrodes in an operating position that are fastened at one end and fit into a tube at the other end for support and, during a cleaning operation, are drawn back through a fixed concentric tube scraper.
Figure 5:
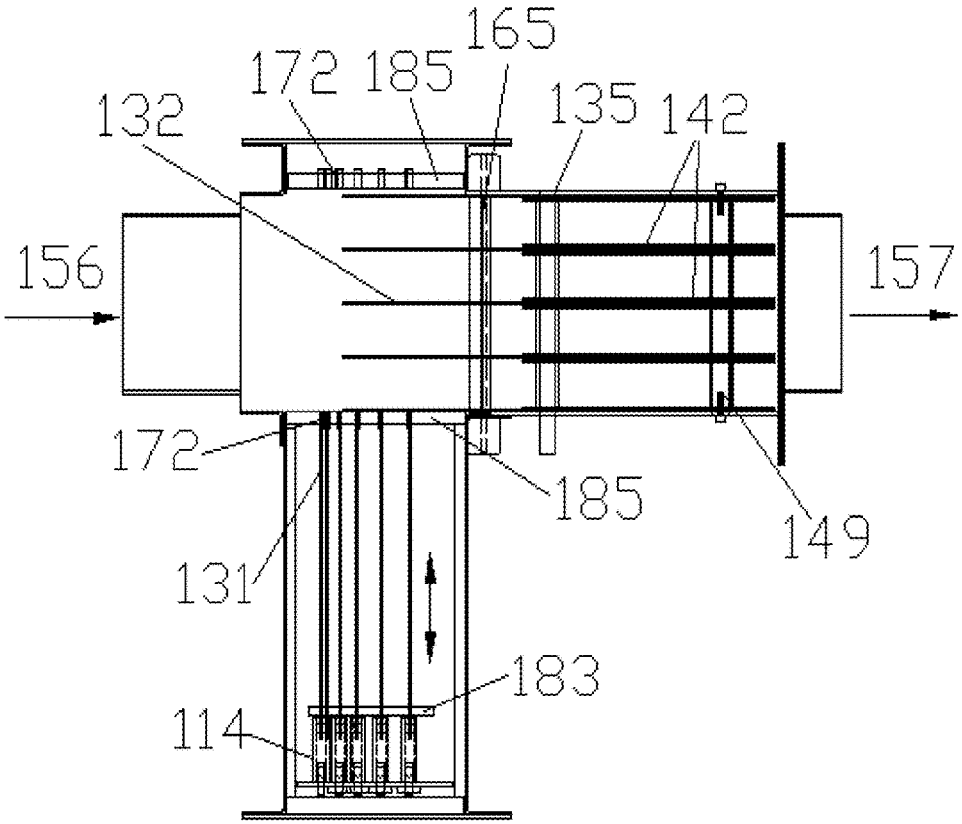
FIG. 5 shows a cross sectional top view of moveable horizontal discharge wire electrodes fastened at both ends and passed through fixed concentric tube scrapers for cleaning.

FIGS. 4 and 5 illustrate the moveable horizontal discharge wire electrodes 131 passing through a fixed concentric short length scraper tube 172 to remove material on the discharge wire electrodes 131. Both of the short length scraper tubes 172 are preferably supported by dielectric panels 185. FIG. 4 shows the discharge wire or rod electrodes 131 in operating position and FIG. 5 shows the discharge wire electrodes 131 retracted after being drawn through the scraper tube 172. One of the differences between FIGS. 2 and 3 and FIGS. 4 and 5 is that, in FIGS. 4 and 5, the discharge wire electrodes 131 can be of a smaller diameter, requiring less power to generate an electrical discharge to charge the particulates. FIG. 5 also shows that the discharge electrode support bar 183 does not move in front of the disc electrodes 132. Instead, it remains outside the main air stream. This embodiment also preferably includes using higher refractory dielectric materials in any location the horizontal discharge electrodes 131 pass through. As one example, wear resistant non-conductive refractory tubes 172 are embededd in the dielectric panels 185.

Figure 6:
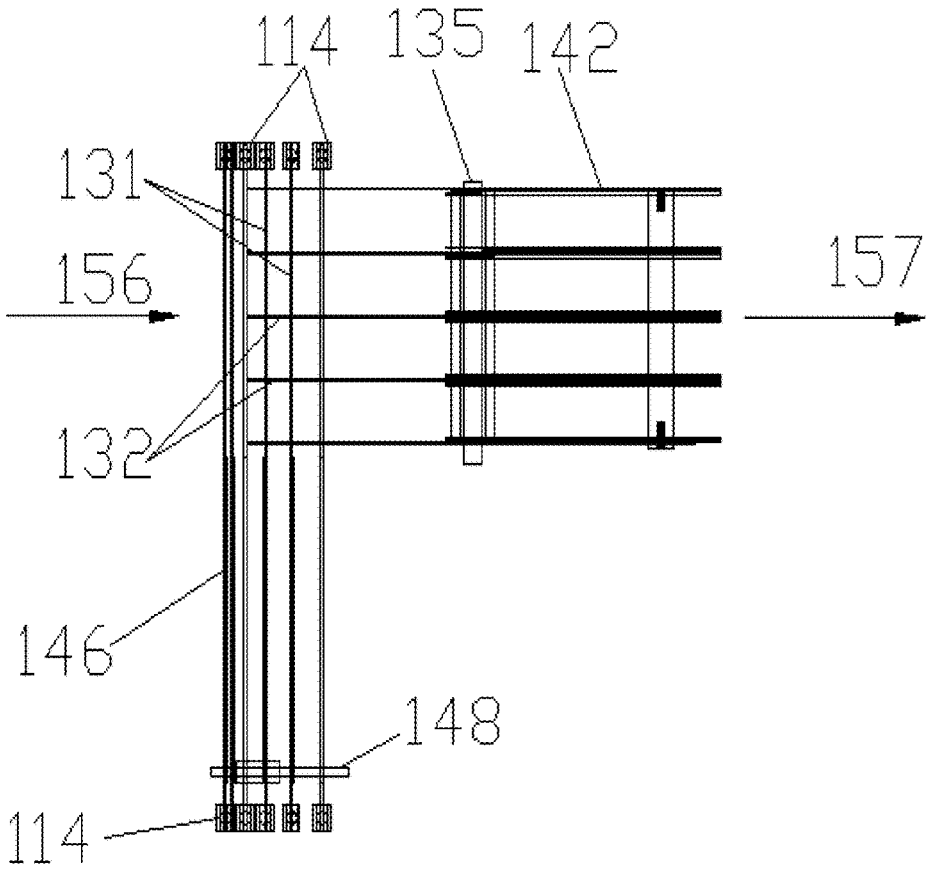
FIG. 6 shows a cross sectional top view of horizontal moveable discharge wire electrodes fastened at both ends in an operating position.

FIG. 6 shows an electrode configuration that permits the heating of the horizontal discharge electrodes 131 prior to scraping and converts the collected material on the horizontal discharge electrode 131 surface into a powdery state that is relatively easy to remove with the tubular scrapers 146. In this embodiment, the horizontal discharge electrodes 131 are preferably fastened at both ends to electrical terminal connectors 114. Also, the wiring of the discharge electrode circuit may be changed from HVDC (high voltage direct current) to the AC power during the cleaning process. A high current AC circuit heats the horizontal discharge electrodes prior to cleaning the horizontal discharge electrodes.

A heating process may be required because the exhaust from burning coal or wood can produce a creosote soot that is difficult to remove from the discharge electrodes. One solution is to heat the discharge electrodes long enough to break the compounds down until the material can be remove by the scraping tube. The temperature and heating time for coal is higher and longer and generally occurs only at start up.

FIG. 4 also shows the use of extra thermal dielectric material 119 for this embodiment. The enclosure material is preferably made of a combination of conductive and non conductive materials.

Figure 7:
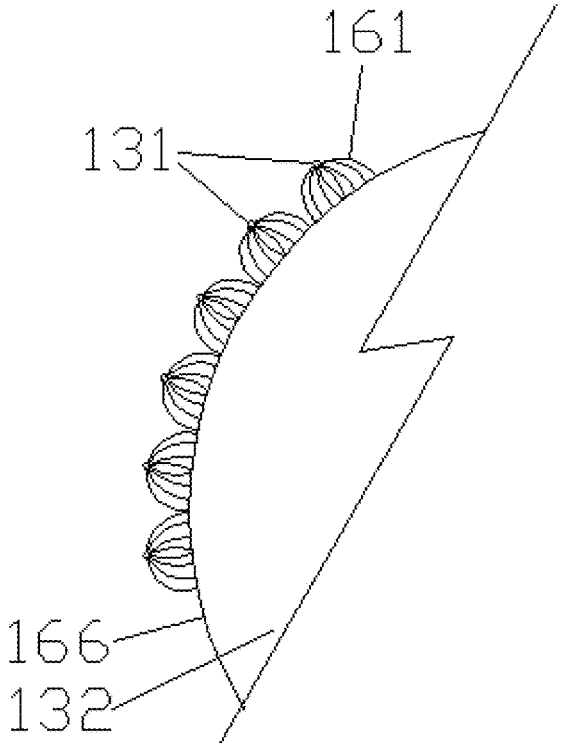
FIG. 7 shows a flux pattern that follows the periphery or leading edge of the circular disc electrodes.
Figure 8:
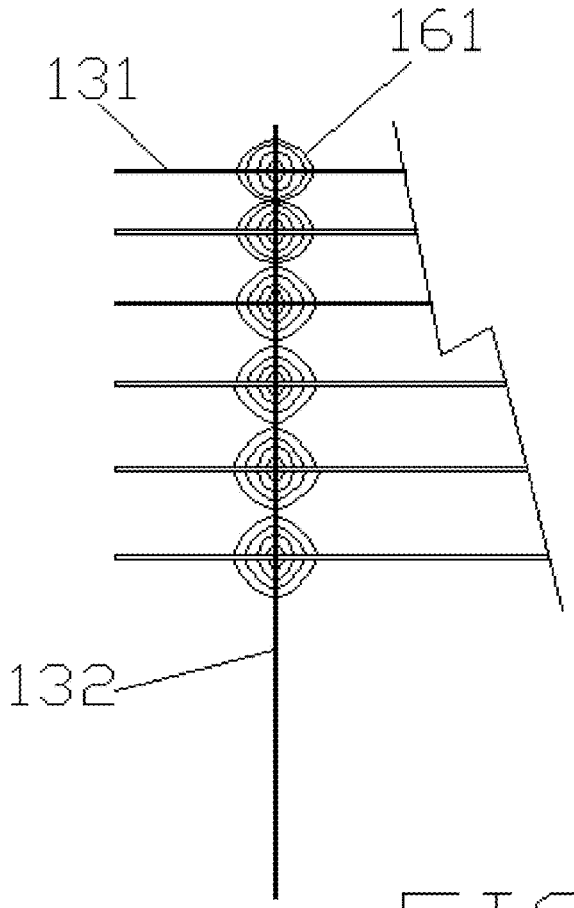
FIG. 8 shows a flux pattern that traverses to the sides of the circular disc electrodes.

Other benefits derived from using horizontal discharge electrodes 131 are shown in FIGS. 7 and 8. FIG. 7 shows a side view of the electrical flux pattern 161 generated by the emission of ions that follows the periphery or the leading edge 166 of a circular disc electrode 132.

FIG. 8 is a front view that shows the electrical flux pattern 161 extending to the sides of the circular disc electrodes 132. The electric field or flux pattern 161 was derived from viewing the distribution pattern of particles collected.

FIGS. 1 and 5 show the relative position of the disc edge scraper 165. In each of these embodiments, the disc edge scraper 165 is located below and out of the main air stream.

Figure 9C:
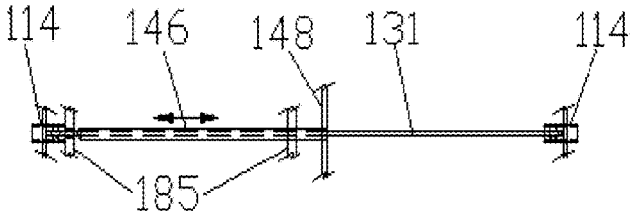
FIG. 9*c* shows a horizontal discharge wire electrode fastened at both ends with a tube scraper in the main air stream.
Figure 9B:
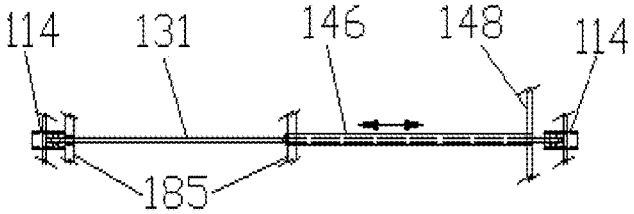
FIG. 9*b* shows a horizontal discharge wire electrode fastened at both ends with a tube scraper out of the main air stream and in operating position.
Figure 9A:
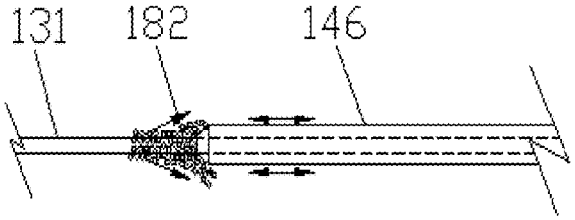
FIG. 9*a* shows a discharge tube scraper moving forward and removing material deposited on a horizontal discharge wire electrode.

FIGS. 9*a* thru 9*g* show examples of the scrapers and how they are used in the disc electrostatic precipitator. FIG. 9*a* shows a discharge tube scraper 146 moving forward and removing material 182 deposited on a horizontal discharge electrode wire 131. In one example, a dimension for the discharge wire electrode is 0.025" and the discharge tube scraper 146 has a 0.027 inner diameter with a 0.007" thick wall. The necessary thickness for the tube walls depends on the difficulty of removing the material from the horizontal discharge electrodes 131. While relatively thin walls could be used, in alternative embodiments, tubes with thicker walls could be used.

FIGS. 9*b* through 9*f* show different ways the discharge wire electrode 131 can be operated.

FIG. 9*b* shows the discharge tube scraper 146 in an operating position and the horizontal discharge electrode 131 attached at both ends to electrical terminal connectors 114. FIG. 9*c* shows where the scraper tube bar 148 moves the discharge tube scraper 146 over the horizontal discharge electrode 131 to remove the collected material 182 (shown in FIG. 9*a*). This electrode arrangement may be used in standard operation when the horizontal discharge electrode 131 is heated.

Figure 9F:
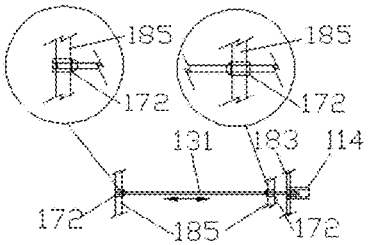
FIG. 9*f* shows a movable horizontal discharge wire electrode design in the main air stream and in an operating position.
Figure 9E:
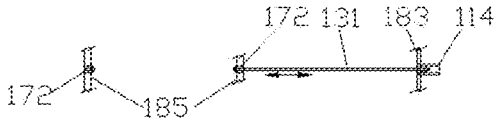
FIG. 9*e* shows a movable horizontal discharge wire electrode design with two fixed tubular scrapers.
Figure 9D:
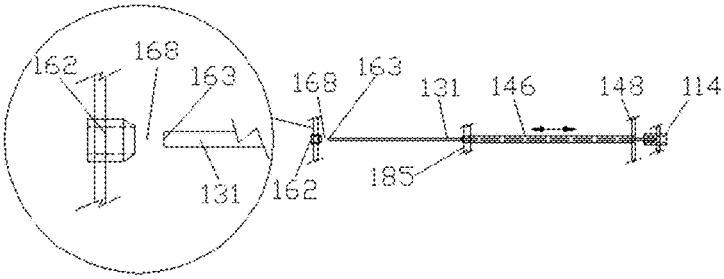
FIG. 9*d* shows a horizontal discharge wire electrode attached only at one end.

FIG. 9*d* shows a discharge tube scraper 146 in operating position over the horizontal discharge electrode 131. In this embodiment, the discharge wire electrode 131 has only one end attached to an electrical terminal connector 114. The open end 163 results in an open space 168 for material to fall off during scraping. FIG. 9*d* also shows a large, stationary tube scraper 162 that can scrape the discharge tube scraper 146.

FIG. 9*e* shows a design where the horizontal discharge electrode 131 moves back and forth by moving the discharge electrode support bar 183. FIG. 9*e* also shows two discharge tube scrapers 172. Cleaning the horizontal discharge electrode 131 takes place at both stationary short tube scraper 172 locations. The stationary short tube scrapers 172 may be made from conductive or non-conductive material. Both short tube scrapers 172 are supported by dielectric panels 185.

FIG. 9*f* shows the movable horizontal discharge electrodes 131 in the main air stream. Cleaning takes place when the horizontal discharge electrode 131 are retracted out of the main air stream and passes through the shorter scraper tube 172 and when the horizontal discharge electrode 131 returns to its operating position.

Figure 9G:
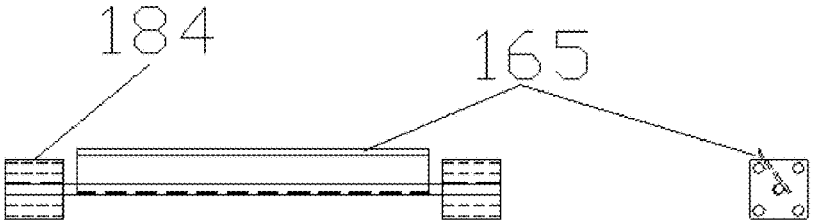
FIG. 9*g* shows a disc edge scraper used to clean the leading edge of a disc electrode.

FIG. 9*g* shows a single blade disc edge scraper 165, which is preferably a flat, thin plate or blade 165, used to clean the leading edge 166 (shown in FIG. 7) of the disc electrode 132. The flat plate 165 is set at a scraping operating angle such that scraped material falls by gravity into the collection chamber. The flat plate 165 is located out of the main air flow to prevent re-entrainment of particles back into the main air stream. In order to keep light pressure on the leading edge 166 of the disc electrode 132, a torsion spring (not shown) is mounted in the disc edge scraper support blocks 184.

Figure 10B:
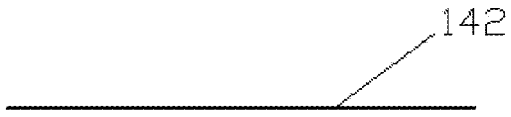
FIG. 10*b* shows a top view of a disc electrode scraper.
Figure 10A:
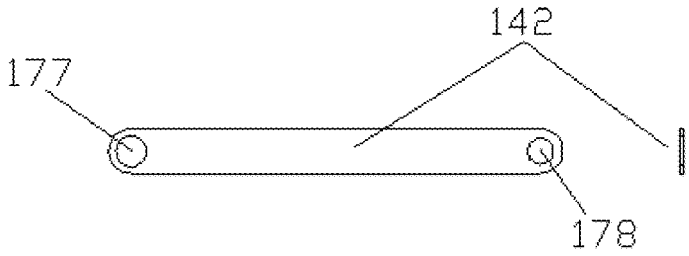
FIG. 10*a* shows a cross-sectional front and side view of a disc electrode scraper.
Figure 10C:
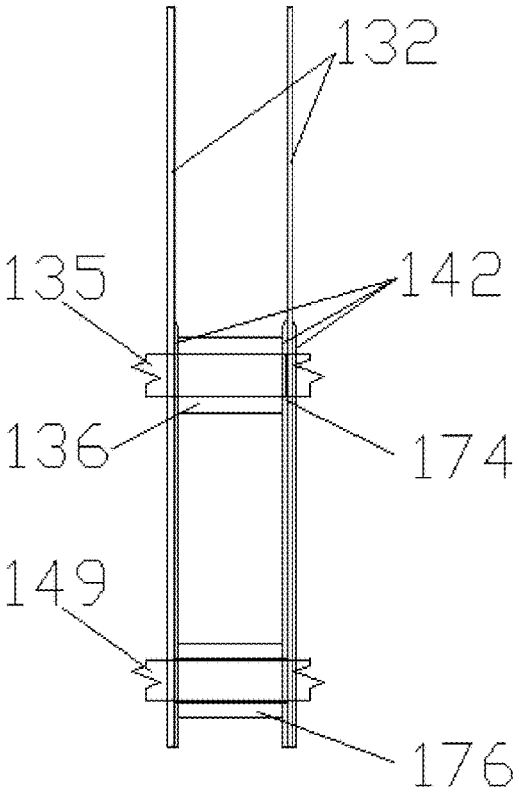
FIG. 10*c* shows an assembled view of two disc electrodes with spacer blocks that control the position of the disc electrode scrapers.
Figure 10D:
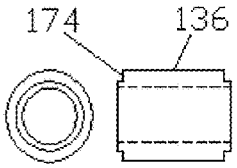
FIG. 10*d* shows a view of a disc electrode scraper spacer block.

FIGS. 10*a* through 10*d* show cross sectional views of a thin flat disc scraper 142 that fits into a groove 174 machined into the disc spacer block 136 and into the scraper shaft spacer block 176 that controls the distance between the disc electrodes 132 and the disc scraper 142. FIG. 10*a* shows clearance holes 177 and 178, required for both the disc rotating shaft 135 and the scraper stationary shaft 149. This embodiment allows for free movement of the disc electrode 132 and closer control in the spacing between the disc electrode 132 and the disc scraper 142. The disc scraper blade 142 shown in FIGS. 10*a* through 10*d* is preferably made from thin gauge spring hardened metal, such as stainless steel.

Figure 11:
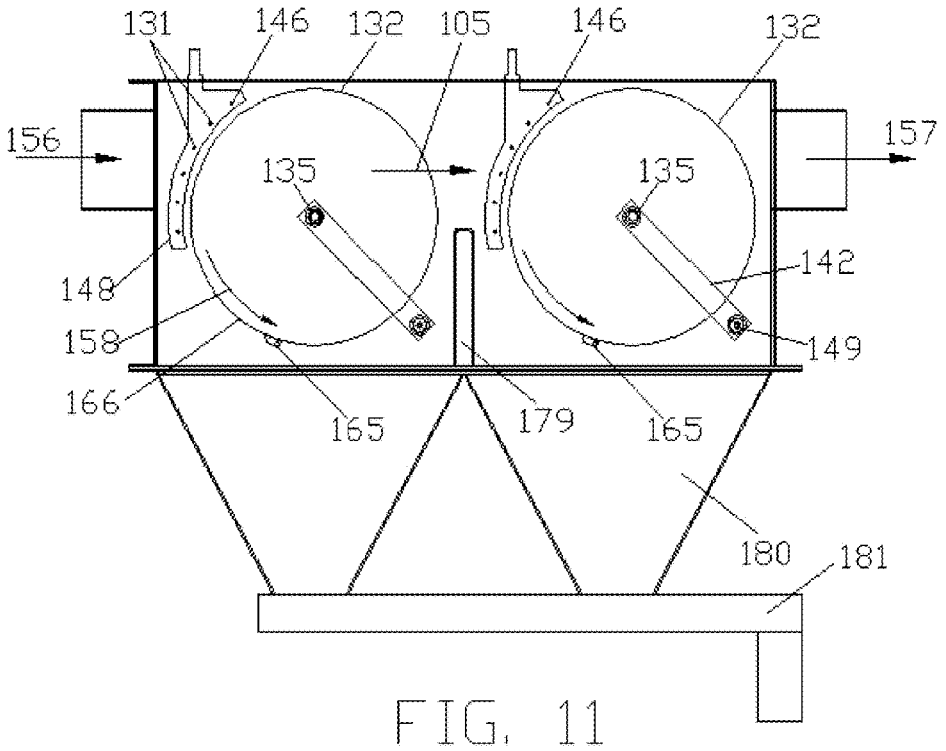
FIG. 11 shows a cross sectional side view of a multi field disc electrostatic precipitator.

FIG. 11 shows a cross sectional side view of a multi field electrostatic precipitator. This embodiment could be used for higher flow applications. The overall size and the number of fields are based on many factors, including, but not limited to, the solids concentration, type of material to be collected and CFM requirements.

FIG. 11 shows the basic location of the disc leading edge scraper 165. In this position, material scraped from the disc leading edge will fall by gravity into the collection hopper 180 and be removed from the precipitator by the auger 181. A field divider 179 is also shown. The field divider 179 keeps the main air flow 105 in the upper half of the disc electrode 132.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A method for removing particles from a single main air stream in a disc electrostatic precipitator comprising a plurality of vertical rotatable circular disc collecting electrodes and a plurality of horizontal discharge electrodes located along an outer circumference of the vertical rotatable circular disc collecting electrodes, comprising the step of passing entrained air through the plurality of horizontal discharge electrodes and the plurality of vertical rotatable circular disc collecting electrodes, wherein a polarity of the vertical rotatable circular disc collecting electrodes is located at ground potential and high voltage direct current is applied to the horizontal discharge electrodes such that an electrical field is established between the horizontal discharge electrodes and the vertical rotatable circular disc collecting electrodes.

2. The method of claim 1, wherein the single main air stream is located above a center line of the vertical rotatable circular disc collecting electrodes.

3. The method of claim 1, further comprising the step of cleaning the plurality of horizontal discharge electrodes during a precipitating process using a plurality of concentric, moveable tubular scrapers that traverse over the horizontal discharge electrodes to remove material deposited on the horizontal discharge electrodes.

4. The method of claim 3, wherein a first end of the horizontal discharge electrodes are fastened to electrical terminal connectors and a second end is unattached, to assist in removal of material collected on the horizontal discharge electrodes during operation.

5. The method of claim 4, further comprising the step of moving the horizontal discharge electrodes from an operating position through the concentric, moveable tubular scrapers while the concentric, moveable tubular scrapers are stationary to remove the collected material.

6. The method of claim 3, wherein the material removed from the horizontal discharge electrodes falls by gravity into a collection chamber below the horizontal discharge electrodes.

7. The method of claim 3, further comprising the step of cleaning ends of the concentric, moveable tubular scrapers by moving the concentric, moveable tubular scrapers into concentric tubes shaped to fit the concentric, moveable tubular scrapers, at an end of the scraping process.

8. The method of claim 1, further comprising the step of cleaning a leading edge of the disc electrodes using a thin, flat blade that is set at a scraping operating angle such that scraped material falls by gravity into a collection chamber and the flat blade is located out of the main air flow to prevent re-entrainment of particles back into the main air stream.

9. The method of claim 1, further comprising the step of cleaning the plurality of vertical rotatable circular disc collecting electrodes during the precipitating process with a plurality of disc scrapers that are freely supported on a stationary disc scraper shaft at a first, lower end and are freely supported on a disc drive shaft at a second end, wherein a position of the disc scrapers relative to the vertical rotatable circular disc collecting electrodes is controlled by a first spacer positioned between the vertical rotatable circular disc collecting electrodes and a second spacer located on the disc scraper shaft.

10. The method of claim 1, further comprising the step of cleaning the horizontal discharge electrodes with a plurality of concentric, moveable tubular scrapers in the disc electrostatic precipitator.

11. The method of claim 10, further comprising the step of heating the horizontal discharge electrodes prior to cleaning the horizontal discharge electrodes, wherein a high current AC circuit heats the horizontal discharge electrodes.

12. The method of claim 1, further comprising the step of cleaning the vertical rotatable circular disc collecting electrodes with a plurality of disc scrapers in the disc electrostatic precipitator.

13. A disc electrostatic precipitator for removing particles from a single main air stream, comprising:

a plurality of vertical rotatable circular disc collecting electrodes; and a plurality of horizontal discharge electrodes located along an outer circumference of the vertical rotatable circular disc collecting electrodes;

wherein a polarity of the vertical rotatable circular disc collecting electrodes is located at ground potential and high voltage direct current is applied to the horizontal discharge electrodes such that there is an electrical field established between the horizontal discharge electrodes and the vertical rotatable circular disc collecting electrodes.

14. The disc electrostatic precipitator of claim 13, wherein the single main air stream is located above a center line of the vertical rotatable circular disc collecting electrodes.

15. The disc electrostatic precipitator of claim 13, further comprising a plurality of concentric, moveable tubular scrapers shaped to fit the horizontal discharge electrodes such that the concentric, moveable tubular scrapers scrape the horizontal discharge electrodes to remove material deposited on the horizontal discharge electrodes.

16. The disc electrostatic precipitator of claim 15, wherein a first end of the horizontal discharge electrodes are fastened to electrical terminal connectors and a second end is unattached.

17. The disc electrostatic precipitator of claim 15, further comprising a collection chamber located below the horizontal discharge electrodes, wherein the material removed from the horizontal discharge electrodes falls by gravity into the collection chamber.

18. The disc electrostatic precipitator of claim 15, further comprising concentric tubes shaped to fit the concentric, moveable tubular scrapers, wherein the concentric tubes clean the concentric, moveable tubular scrapers at an end of a cleaning process.

19. The disc electrostatic precipitator of claim 13, further comprising a plurality of first electrode scrapers fixed on each side of the vertical rotatable circular disc collecting electrodes, wherein the first electrode scrapers are located out of the main air stream.

20. The disc electrostatic precipitator of claim 13, further comprising a collecting chamber located below the vertical rotatable circular disc collecting electrodes and a thin, flat blade that is set at a scraping operating angle along a leading edge of the vertical rotatable circular disc collecting electrodes such that material scraped from a leading edge of the vertical rotatable circular disc collecting electrodes falls by gravity into the collection chamber, and the flat blade is located out of the main air stream to prevent re-entrainment of particles back into the main stream.

21. The disc electrostatic precipitator of claim 13, further comprising a plurality of concentric, moveable tubular scrapers that slide over the horizontal discharge electrodes to remove deposited material, wherein the concentric, moveable tubular scrapers are located out of the air stream.

22. The disc electrostatic precipitator of claim 13, wherein a distance between the horizontal discharge electrodes is greater than a distance between the horizontal discharge electrodes and a leading edge of the vertical rotatable disc collecting electrodes.

23. The disc electrostatic precipitator of claim 13, further comprising a plurality of disc scrapers that are supported by scraper shaft spacer blocks located at a first end of the disc scrapers and are supported at a second end on a disc support shaft spacer, wherein a position of the disc scrapers relative to the vertical rotatable circular disc collecting electrodes is controlled by an offset in the scraper shaft spacer blocks and the disc support shaft spacer.

24. The disc electrostatic precipitator of claim 13, further comprising at least one disc edge scraper located along a leading edge of the vertical rotatable circular disc collecting electrodes, wherein an angle of the disc edge scraper is designed so that material scraped from the leading edge of the vertical rotatable circular disc collecting electrodes free falls by gravity into a collection chamber.

25. A method for keeping a plurality of horizontal discharge wire electrodes in a disc electrostatic precipitator clean during a precipitating process comprising the step of cleaning the horizontal discharge wire electrodes using a plurality of concentric tubular scrapers that traverse over the horizontal discharge wire electrodes to remove material deposited on the horizontal discharge wire electrodes.

26. The method of claim 25, wherein a first end of the horizontal discharge electrodes is fastened to electrical terminal connectors and a second end is unattached, to assist in removal of material collected on the horizontal discharge electrode during operation.

27. The method of claim 25, comprising the substep of moving the horizontal discharge electrodes from an operating position back through the concentric tubular scrapers to remove the collected material.

28. The method of claim 25, wherein the material removed from the horizontal discharge wire electrodes falls by gravity into a collection chamber below the horizontal discharge wire electrodes.

29. The method of claim 25, further comprising the step of cleaning ends of the concentric tubular scrapers by moving the concentric tubular scrapers into concentric tubes shaped to fit the concentric tubular scrapers at an end of the cleaning process.

30. A method for keeping a plurality of disc electrodes in a disc electrostatic precipitator clean comprising the steps of:

cleaning a leading edge of the disc electrodes using a thin, flat blade that is set at a scraping operating angle such that scraped material free falls via gravity into a collection chamber and the flat blade is located out of the main air flow to prevent re-entrainment of particles back into a main stream; and cleaning the disc electrodes with a plurality of disc scrapers supported by scraper shaft spacer blocks at a first, lower end and supported at a second end on a disc support shaft spacer, wherein a position of the disc scrapers relative to the disc electrodes is controlled by an offset in the scraper shaft spacer blocks and the disc support shaft spacer.

31. A method for removing particles from a single main air stream in a disc electrostatic precipitator comprising the steps of:

passing entrained air through a plurality of horizontal discharge electrodes and through a plurality of vertical circular disc collecting electrodes, wherein the plurality of horizontal discharge electrodes are located along an outer circumference of the vertical rotatable circular disc collecting electrodes; and cleaning the horizontal discharge electrodes and the vertical circular disc collecting electrodes with a plurality of scrapers;

wherein the plurality of scrapers are located out of the single main air stream.

32. The method of claim 31, wherein the plurality of scrapers comprise a plurality of disc edge scrapers that clean a leading edge of the disc electrodes and a plurality of side disc scrapers that clean sides of the disc electrodes.

33. The method of claim 31, wherein the plurality of scrapers comprise a plurality of concentric tubular scrapers that clean the plurality of horizontal discharge electrodes.

34. The method of claim 30, wherein the disc scrapers are made of a dielectric refractory tubular material.

* * * * *